US009396700B2

(12) United States Patent
Furumoto et al.

(10) Patent No.: US 9,396,700 B2
(45) Date of Patent: Jul. 19, 2016

(54) DISPLAY APPARATUS AND CONTROL METHOD THEREOF

(71) Applicant: CANON KABUSHIKI KAISHA, Tokyo (JP)

(72) Inventors: Yoshihisa Furumoto, Machida (JP); Takeshi Ikeda, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/449,292

(22) Filed: Aug. 1, 2014

(65) Prior Publication Data

US 2015/0035848 A1 Feb. 5, 2015

(30) Foreign Application Priority Data

Aug. 5, 2013 (JP) ..... 2013-162572

(51) Int. Cl.
*G09G 5/02* (2006.01)
*G09G 3/34* (2006.01)

(52) U.S. Cl.
CPC ..... *G09G 5/026* (2013.01); *G09G 3/3426* (2013.01); *G09G 2320/0238* (2013.01); *G09G 2320/0242* (2013.01); *G09G 2320/0646* (2013.01)

(58) Field of Classification Search
CPC ..... G06T 2207/20212; G09G 2340/10; G09G 2340/12; G09G 2320/0233; G09G 2320/0626; G09G 2320/0633; G09G 2320/0646; H04N 5/57
See application file for complete search history.

(56) References Cited

U.S. PATENT DOCUMENTS 6,956,586 B2 * 10/2005 Takagi ..... H04N 5/44504 345/589
8,026,935 B2 * 9/2011 Tsai ..... G09G 3/3406 345/102
9,058,510 B1 * 6/2015 Bold ..... G06T 1/00
2012/0139956 A1 * 6/2012 Joseph ..... G09F 9/30 345/690

FOREIGN PATENT DOCUMENTS

JP 2002-099250 A 4/2002
JP 2010-096857 A 4/2010
JP 2011-209407 A 10/2011
JP 2012-242672 A 12/2012

OTHER PUBLICATIONS

The above foreign patent document was in the Mar. 1, 2016 Japanese Office Action.

* cited by examiner

*Primary Examiner* — Antonio A Caschera
(74) *Attorney, Agent, or Firm* — Cowan, Liebowitz & Latman, P.C.

(57) ABSTRACT

A display apparatus according to the present invention, comprises: a light-emitting unit having a plurality of light sources, the emission brightness of which can be individually changed; a display unit configured to display an image on a screen by modulating light from the light-emitting unit; and a control unit configured to control the emission brightness of each of the light sources according to a brightness of an image to be displayed in a region on the screen corresponding to each of the plurality of light sources, wherein when a graphic image is superimposed on an original image and is displayed, the control unit changes the emission brightness of each of the light sources according to a type of the graphic image.

20 Claims, 19 Drawing Sheets

ORIGINAL IMAGE

SAFETY AREA MARKER

GUI

COMPOSITE IMAGE OF FIG. 2A AND FIG. 2B

COMPOSITE IMAGE OF FIG. 2A AND FIG. 2C

FIG. 3A

BRIGHTNESS FEATURE VALUE OF ORIGINAL IMAGE

| | | | | | | | |
|---|---|---|---|---|---|---|---|
| 0 | 0 | 0 | 0 | 0 | 0 | 0 | 0 |
| 0 | 255 | 0 | 0 | 0 | 0 | 255 | 192 |
| 0 | 0 | 0 | 0 | 0 | 0 | 192 | 192 |
| 0 | 0 | 0 | 128 | 128 | 192 | 192 | 192 |
| 0 | 0 | 128 | 128 | 192 | 192 | 192 | 192 |
| 0 | 128 | 128 | 192 | 192 | 192 | 192 | 192 |

FIG. 3B

BRIGHTNESS FEATURE VALUE OF COMPOSITE IMAGE OF FIG. 2A AND FIG. 2B

| | | | | | | | | |
|---|---|---|---|---|---|---|---|---|
| 255 | 255 | 255 | 255 | 255 | 255 | 255 | 255 | 255 |
| 255 | 255 | 0 | 0 | 0 | 0 | 255 | 255 | 255 |
| 255 | 0 | 0 | 0 | 0 | 0 | 192 | 255 | 255 |
| 255 | 0 | 0 | 128 | 128 | 192 | 192 | 255 | 255 |
| 255 | 0 | 128 | 128 | 192 | 192 | 192 | 255 | 255 |
| 255 | 255 | 255 | 255 | 255 | 255 | 255 | 255 | 255 |

REGION WHERE BRIGHTNESS FEATURE VALUE CHANGE DUE TO COMPOSITION OF GRAPHIC IMAGE

FIG. 3C

BRIGHTNESS FEATURE VALUE OF COMPOSITE IMAGE OF FIG. 2A AND FIG. 2C

| | | | | | | |
|---|---|---|---|---|---|---|
| 255 | 255 | 255 | 255 | 0 | 0 | 0 |
| 255 | 255 | 255 | 255 | 0 | 255 | 192 |
| 255 | 255 | 255 | 255 | 0 | 192 | 192 |
| 255 | 255 | 255 | 255 | 192 | 192 | 192 |
| 0 | 0 | 128 | 192 | 192 | 192 | 192 |
| 0 | 128 | 128 | 192 | 192 | 192 | 192 |

REGION WHERE BRIGHTNESS FEATURE VALUE CHANGE DUE TO COMPOSITION OF GRAPHIC IMAGE

FIG. 4

RANK INFORMATION STORAGE TABLE

| TIPE INFORMATION | RANK INFORMATION |
|---|---|
| GUI | 1 |
| SAFETY AREA MARKER | 0 |

FIG. 5A

TARGET BRIGHTNESS (%)

| | | | | | | | |
|---|---|---|---|---|---|---|---|
| 0 | 0 | 0 | 0 | 0 | 0 | 0 | 0 |
| 0 | 100 | 0 | 0 | 0 | 0 | 100 | 75 |
| 0 | 0 | 0 | 0 | 0 | 0 | 75 | 75 |
| 0 | 0 | 0 | 50 | 50 | 75 | 75 | 75 |
| 0 | 0 | 50 | 50 | 75 | 75 | 75 | 75 |
| 0 | 50 | 50 | 75 | 75 | 75 | 75 | 75 |

FIG. 5B

TARGET BRIGHTNESS (%)

| | | | | | | | |
|---|---|---|---|---|---|---|---|
| 100 | 100 | 100 | 100 | 100 | 0 | 0 | 0 |
| 100 | 100 | 100 | 100 | 100 | 0 | 100 | 75 |
| 100 | 100 | 100 | 100 | 100 | 0 | 75 | 75 |
| 100 | 100 | 100 | 100 | 100 | 75 | 75 | 75 |
| 0 | 0 | 50 | 50 | 75 | 75 | 75 | 75 |
| 0 | 50 | 50 | 75 | 75 | 75 | 75 | 75 |

GUI DISPLAY PORTION

DISPLAYED IMAGE

BRIGHTNESS REPRODUCIBILITY OF ORIGINAL IMAGE IS MAINTAINED BY USING BRIGHTNESS FEATURE VALUE OF ORIGINAL IMAGE

BRIGHTNESS REPRODUCIBILITY OF GRAPHIC IMAGE IS MAINTAINED BY USING BRIGHTNESS FEATURE VALUE OF COMPOSITE IMAGE

DISPLAYED IMAGE

FIG. 9A

BRIGHTNESS FEATURE VALUE OF ORIGINAL IMAGE

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

FIG. 9B

BRIGHTNESS FEATURE VALUE OF COMPOSITE IMAGE

DISPLAY PORTION OF SAFETY AREA MARKER

| | | | | | | | |
|---|---|---|---|---|---|---|---|
| 255 | 255 | 255 | 255 | 255 | 255 | 255 | 255 |
| 255 | 0 | 0 | 0 | 0 | 0 | 0 | 255 |
| 255 | 0 | 0 | 0 | 0 | 0 | 0 | 255 |
| 255 | 0 | 0 | 0 | 0 | 0 | 0 | 255 |
| 255 | 0 | 0 | 0 | 0 | 0 | 0 | 255 |
| 255 | 255 | 255 | 255 | 255 | 255 | 255 | 255 |

FIG. 10A

DIFFERENCE OF BRIGHTNESS FEATURE VALUE

DIFFERENCE ≠ 0

| | | | | | | | |
|---|---|---|---|---|---|---|---|
| 255 | 255 | 255 | 255 | 255 | 255 | 255 | 255 |
| 255 | 0 | 0 | 0 | 0 | 0 | 0 | 255 |
| 255 | 0 | 0 | 0 | 0 | 0 | 0 | 255 |
| 255 | 0 | 0 | 0 | 0 | 0 | 0 | 255 |
| 255 | 0 | 0 | 0 | 0 | 0 | 0 | 255 |
| 255 | 255 | 255 | 255 | 255 | 255 | 255 | 255 |

FIG. 10B

REGION INFORMATION

DISPLAY PORTION OF SAFETY AREA MARKER

| | | | | | | | |
|---|---|---|---|---|---|---|---|
| 1 | 1 | 1 | 1 | 1 | 1 | 1 | 1 |
| 1 | 0 | 0 | 0 | 0 | 0 | 0 | 1 |
| 1 | 0 | 0 | 0 | 0 | 0 | 0 | 1 |
| 1 | 0 | 0 | 0 | 0 | 0 | 0 | 1 |
| 1 | 0 | 0 | 0 | 0 | 0 | 0 | 1 |
| 1 | 1 | 1 | 1 | 1 | 1 | 1 | 1 |

DISPLAYED IMAGE

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

Conventionally, as a technology related to a liquid crystal display apparatus, a technique of using a backlight including a plurality of light sources, and controlling the emission brightness of each light source and the transmittance of the liquid crystal panel according to the brightness of the image to be displayed has been proposed (Japanese Patent Application Laid-open No. 2002-99250). Specifically, with the technology described in Japanese Patent Application Laid-open No. 2002-99250, the emission is controlled so that the emission brightness becomes lower in a dark region of the image in comparison to a bright region. Based on this kind of control, it is possible to reduce a misadjusted black level, and improve the contrast of the displayed image (image displayed on the screen).

With the conventional technology described above, when superimposing a graphic image on an original image and displaying the same, as with an on-screen display (OSD), for example, the emission brightness of each light source is controlled according to the brightness of the composite image that is obtained by compositing the graphic image with the original image. Nevertheless, when this kind of control is performed, in cases where the brightness of the graphic image differs considerably from the brightness of the original image (surrounding image) in a region surrounding the graphic image in the composite image, the picture quality of the original image (specifically, the surrounding image) will deteriorate considerably in the displayed image. For example, when the graphic image is extremely dark in comparison to the surrounding image in the composite image, a misadjusted black level of the surrounding image will arise in the displayed image.

Note that, when a graphic image is superimposed on an original image and is displayed, controlling the emission brightness of each light source according to the brightness of the original image may also be considered. When this kind of control is performed, the original image can be displayed without deteriorating the picture quality. Nevertheless, in cases where the brightness of the graphic image differs considerably from the brightness of the surrounding image in the composite image, the picture quality of the graphic image will deteriorate considerably in the displayed image. For example, when the surrounding image is extremely dark in comparison to the graphic image in the composite image, the visibility of the graphic image in the displayed image will deteriorate.

Conventional technology that gives consideration to the foregoing problems is disclosed, for example, in Japanese Patent Application Laid-open No. 2011-209407. With the technology disclosed in Japanese Patent Application Laid-open No. 2011-209407, the target brightness of each light source is decided according to the brightness of the original image, and the target brightness is corrected according to the brightness of the composite image.

There are various types of graphic images. For example, as graphic images, there is a graphic image of a type (first type) in which the picture quality of the original image should be preferentially controlled in comparison to the picture quality of the graphic image. Moreover, as graphic images, there is a graphic image of a type (second type) in which the picture quality of the graphic image should be preferentially controlled in comparison to the picture quality of the original image. Nevertheless, with the technology disclosed in Japanese Patent Application Laid-open No. 2011-209407, the emission brightness is controlled so that the deterioration in the picture quality of both the graphic image and the original image is suppressed. Thus, while it is possible to suppress the deterioration in the picture quality of the graphic image to a certain extent and suppress the deterioration in the picture quality of the original image to a certain extent, when the graphic image is the graphic image of the foregoing first type or second type, the emission brightness cannot be appropriately controlled. For example, when the graphic image is the foregoing first type graphic image, since the target brightness is corrected so as to suppress the deterioration in the picture quality of the graphic image, it is not possible to control the emission brightness so that the deterioration in the picture quality of the original image is sufficiently suppressed. Moreover, when the graphic image is the foregoing second type graphic image, since the target brightness is corrected only to a level of maintaining the picture quality of the original image, it is not possible to control the emission brightness so that the picture quality of the graphic image is sufficiently suppressed.

SUMMARY OF THE INVENTION

The present invention provides a technology capable of controlling the emission brightness of each light source to be an appropriate value when a graphic image is superimposed on an original image and is displayed.

The present invention in its first aspect provides a display apparatus, comprising:

a light-emitting unit having a plurality of light sources, the emission brightness of which can be individually changed;

a display unit configured to display an image on a screen by modulating light from the light-emitting unit; and a control unit configured to control the emission brightness of each of the light sources according to a brightness of an image to be displayed in a region on the screen corresponding to each of the plurality of light sources, wherein when a graphic image is superimposed on an original image and is displayed, the control unit changes the emission brightness of each of the light sources according to a type of the graphic image so that the emission brightness becomes equal to an emission brightness according to a brightness of the original image when the type of the graphic image is a first type, and so that the emission brightness becomes equal to an emission brightness according to a brightness of a composite image obtained by compositing the graphic image on the original image when the type of the graphic image is a second type.

The present invention in its second aspect provides a control method for a display apparatus including a light-emitting unit having a plurality of light sources, the emission brightness of which can be individually changed, and a display unit that displays an image on a screen by modulating light from the light-emitting unit, the control method comprising:

an input step of inputting the image data into the display unit; and a control step of controlling the emission brightness of each of the light sources according to a brightness of an image to be displayed in a region on the screen corresponding to each of the plurality of light sources, wherein when a graphic image is superimposed on an original image and is displayed, in the control step, the emission brightness of each Of the light sources is changed according to a type of the graphic image so that the emission brightness becomes equal to an emission brightness according to a brightness of the original image when the type of the graphic image is a first type, and so that the emission brightness becomes equal to an emission brightness according to a brightness of a composite image obtained by compositing the graphic image on the original image when the type of the graphic image is a second type.

The present invention in its third aspect provides a non-transitory computer readable medium that stores a program, wherein the program causes a computer to execute the method.

According to the present invention, the emission brightness of each light source can be controlled to be an appropriate value when a graphic image is superimposed on an original image and is displayed.

Further features of the present invention will become apparent from the following description of exemplary embodiments with reference to the attached drawings.

BRIEF DESCRIPTION OF THE DRAWINGS

FIGS. 3A to 3C are diagrams showing an example of the brightness feature value according to embodiment 1;

FIG. 4 is a diagram showing an example of the rank information storage table according to embodiment 1;

FIGS. 5A, 5B are diagrams showing an example of the target brightness according to embodiment 1;

FIGS. 9A, 9B are diagrams showing an example of the brightness feature value according to embodiment 2;

FIGS. 10A, 10B are diagrams showing an example of the difference in the brightness feature value and the region information according to embodiment 2.

DESCRIPTION OF THE EMBODIMENTS

<Embodiment 1>

The display apparatus and its control method according to embodiment 1 of the present invention are now explained.

Note that, in this embodiment, while a case is explained where the display apparatus is a transmissive liquid crystal display apparatus, the display apparatus is not limited to a transmissive liquid crystal display apparatus. The display apparatus may be any display apparatus including independent light sources. For example, the display apparatus may also be a reflective liquid crystal display apparatus. Moreover, the display apparatus may also be an MEMS shutter-type display that uses a microelectromechanical system (MEMS) shutter in substitute for liquid crystal elements.

(Overall Configuration)

Figure 1:
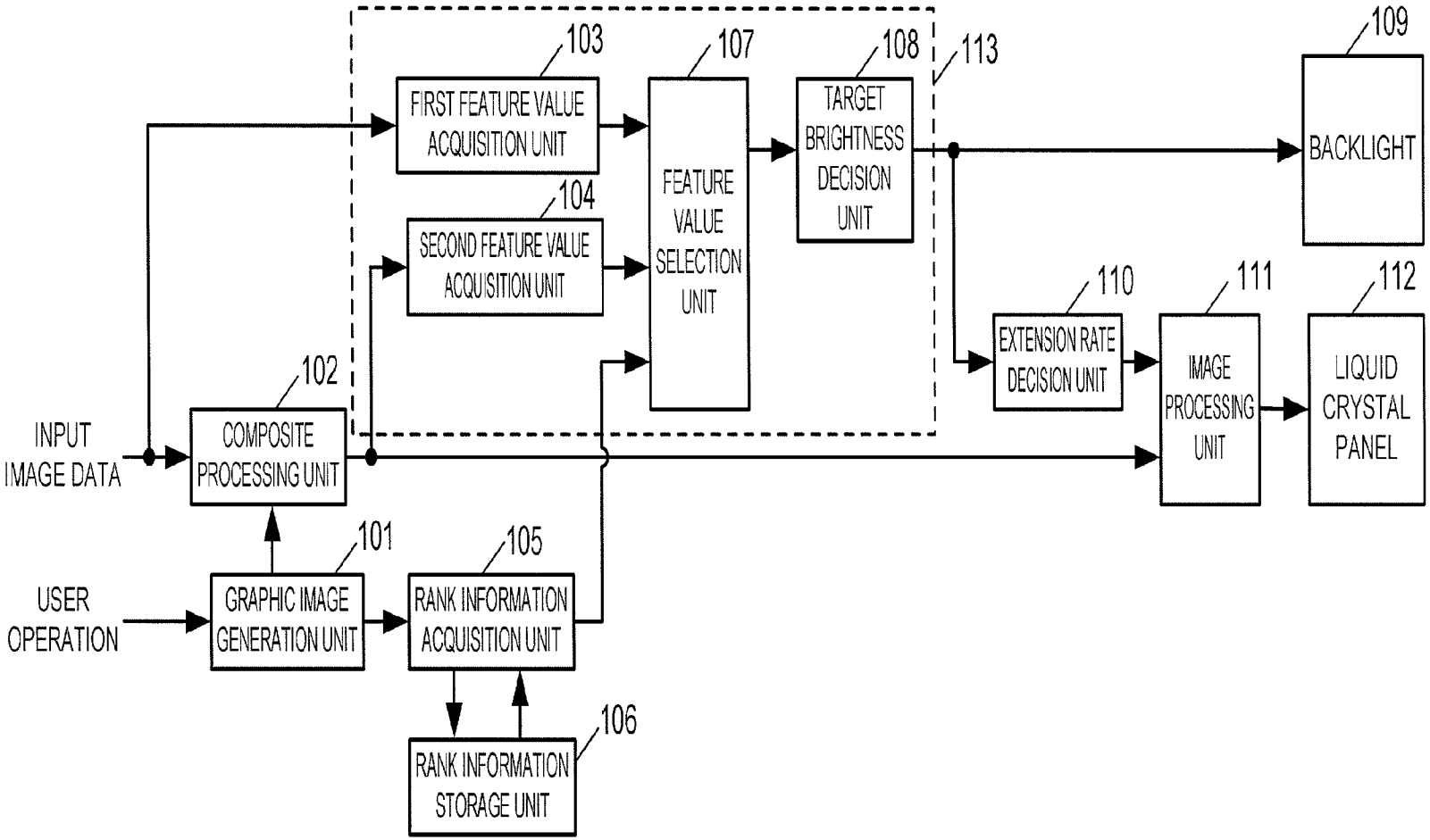
FIG. 1 is a block diagram showing an example of the functional configuration of the display apparatus according to embodiment 1.

FIG. 1 is a block diagram showing an example of the functional configuration of the display apparatus according to this embodiment. As shown in FIG. 1, the display apparatus according to this embodiment includes a graphic image generation unit 101, a composite processing unit 102, an emission brightness control unit 113, a rank information acquisition unit 105, a rank information storage unit 106, a backlight 109, an extension rate decision unit 110, an image processing unit 111, a liquid crystal panel 112, and the like.

The backlight 109 is a light-emitting unit including a plurality of light sources in which the emission brightness of the light sources can be independently changed. The light source includes one or more light-emitting members. As the light-emitting member, used may be, for example, an LED, an organic EL element, a cold-cathode tube, or the like.

The liquid crystal panel 112 is a display unit that displays an image on a screen by modulating the light from the backlight 109. Specifically, the liquid crystal panel 112 displays an image on a screen by transmitting the light from the backlight 109.

The graphic image generation unit 101 generates graphic image data representing the graphic image to be composited with the original image according to the user operation. Specifically, the graphic image generation unit 101 generates graphic image data representing the graphic image to be composited with the original image when the user operation of superimposing a graphic image on an original image and displaying the same is performed.

Subsequently, the graphic image generation unit 101 outputs the generated graphic image data, and type information representing the type of graphic image that is represented by the graphic image data. Specifically, the graphic image data is output to the composite processing unit 102, and the type information is output to the rank information acquisition unit 105.

In this embodiment, a plurality of graphic images, and a plurality of type information corresponding to the plurality of graphic images are prepared in advance. The graphic image generation unit 101 selects one graphic image among the plurality of graphic images according to the user operation, and generates graphic image data representing the selected graphic image. Subsequently, the graphic image generation unit 101 outputs the generated graphic image data and the type information representing the type of graphic image that is represented by the graphic image data.

The composite processing unit 102 generates a composite image by compositing the original image and the graphic image when a graphic image is superimposed on an original image and is displayed. Specifically, the composite processing unit 102 composites original image data representing the original image (input image data that was input to the display apparatus) and graphic image data output from the graphic image generation unit 101 when a graphic image is superimposed on an original image and is displayed. Composite image data representing the composite image is thereby generated.

Subsequently, the composite processing unit 102 outputs the generated composite image data to the emission brightness control unit 113 (specifically, to the second feature value acquisition unit 104 described later) and the image processing unit 111.

Rank information representing the level of necessity of attracting attention of the user viewing the displayed image (image displayed on the screen) is set (recorded) in the rank information storage unit 106 in advance for each type of graphic image. When the type information is input to the rank information storage unit 106, the rank information storage unit 106 outputs the rank information corresponding to the type represented by that type information.

Note that the rank information may or may not be information that is predetermined by a manufacturer or the like. For example, the rank information may also be information that can be set and changed by the user.

The rank information acquisition unit 105 outputs, to the rank information storage unit 106, the type information output from the graphic image generation unit 101, and acquires the rank information output from the rank information storage unit 106. Subsequently, the rank information acquisition unit 105 outputs the acquired rank information to the emission brightness control unit 113 (specifically, to the feature value selection unit 107 described later).

The emission brightness control unit 113 controls the emission brightness of each light source according to the brightness (luminance) of the image to be displayed in the region on the screen corresponding to each of the plurality of light sources. Specifically, the emission brightness control unit 113 decides the target brightness of each light source according to the brightness of the image to be displayed in the region on the screen corresponding to each of the plurality of light sources. Subsequently, the emission brightness control unit 113 controls the emission brightness of each light source to be the target brightness. Moreover, the emission brightness control unit 113 outputs, to the extension rate decision unit 110, information representing the target brightness of each light source.

Note that, in this embodiment, let it be assumed that the region of the screen is configured from a plurality of regions corresponding to a plurality of light sources. Specifically, as shown in FIG. 3A, let it be assumed that 48 divided regions of 6 lines and 8 columns obtained by dividing the region of the screen are set, and that a light source is provided for each divided region. In addition, let it be assumed that the emission brightness of the light source corresponding to the divided regions is controlled according to the brightness of the image to be displayed in the divided region for each divided region. In FIG. 3A, the region shown with a thick solid line is the region of the screen, and each of the 48 regions obtained by dividing the region shown with the thick solid line by the thin broken lines is the divided region.

Nevertheless, the regions corresponding to the light sources are not limited to the foregoing divided regions. As the regions corresponding to the light sources, other regions that overlap with the regions corresponding to the light sources may be set, and other regions that are not in contact with the regions corresponding to the light sources may also be set. For example, the regions corresponding to the light sources may be regions of a size that is larger than the divided regions, or regions of a size that is smaller than the divided regions.

Moreover, in this embodiment, while the plurality of light sources are arranged in a matrix, the arrangement is not limited thereto. For example, the plurality of light sources may also be arranged to be aligned unidirectionally in the line direction or column direction. Furthermore, the number of light sources may be more than or less than 48 light sources.

Moreover, in this embodiment, while mutually different plurality of regions were set as the plurality of regions corresponding to the plurality of light sources, the configuration is not limited thereto. For example, as the regions corresponding to the light sources, other regions that are the same as the regions corresponding to the light sources may also be set.

The extension rate decision unit 110 and the image processing unit 111 perform compensation processing, to the composite image data output from the composite processing unit 102, of compensating the change in brightness on the screen caused by the change in the emission brightness of the light sources.

The extension rate decision unit 110 decides the extension rate of the pixel value of the image data on the basis of the target brightness decided by the emission brightness control unit 113. In this embodiment, decided is the extension rate for compensating the change in brightness on the screen caused by the change in the emission brightness of the light sources.

Note that there is no particular limitation regarding the method of deciding the extension. For example, the extension rate may be calculated by using a function representing the correspondence relation of the target brightness and the extension rate, or decided by using a table representing the foregoing correspondence relation.

Moreover, the extension rate may or may not be decided for each region corresponding to the light source. When the display characteristics between the pixels (change in the modulation level of the light from the light-emitting unit relative to the change in the pixel value) are different, the extension rate may also be decided for each pixel. When the brightness of the displayed image change nonlinearly relative to the change of the pixel value, the extension rate of each pixel value may also be decided. When the brightness of the displayed image change nonlinearly relative to the change of the pixel value, the extension rate corresponding to the pixel value of the composite image data may also be decided for each pixel.

The image processing unit 111 corrects the pixel value of the composite image data on the basis of the extension rate decided with the extension rate decision unit 110. Specifically, the image processing unit 111 multiplies the pixel value of the composite image data by the extension rate. Subsequently, the image processing unit 111 outputs the image data subject to image processing to the liquid crystal panel 112.

(Emission Brightness Control Unit 113)

The emission brightness control unit 113 is now explained in detail. The emission brightness control unit 113 according to this embodiment changes the emission brightness of each light source on the basis of the type of graphic image to be superimposed when a graphic image is superimposed on an original image and is displayed.

As shown in FIG. 1, the emission brightness control unit 113 includes a first feature value acquisition unit 103, a second feature value acquisition unit 104, a feature value selection unit 107, a target brightness decision unit 108, and the like.

The first feature value acquisition unit 103 acquires and outputs a brightness feature value (first feature value) representing the brightness of the image from the original image data in the relevant region with regard to each of a plurality of regions (divided regions) corresponding to a plurality of light sources.

Note that, in this embodiment, while the maximum value of the pixel value (maximum pixel value) of the image data in a region is acquired as the brightness feature value of that region, the brightness feature value is not limited thereto. The brightness feature value may also be a representative value (maximum value, minimum value, mode value, median value, average value, or the like) of the pixel value, a representative value of the brightness value obtained from the pixel value, a histogram of the pixel value, a histogram of the brightness value obtained from the pixel value, or the like.

The second feature value acquisition unit 104 acquires and outputs a brightness feature value (second feature value) from the composite image data (composite image data output from the composite processing unit 102) in the relevant region with regard to each of a plurality of regions (divided regions) corresponding to a plurality of light sources.

The feature value selection unit 107 selects either the first feature value or the second feature value according to the type of graphic image to be superimposed. Specifically, the feature value selection unit 107 selects either the first feature value or the second feature value according to the rank information output from the rank information acquisition unit 105. For example, the feature value selection unit 107 selects the first feature value when the value of the rank information is lower than a predetermined value, and selects the second feature value when the value of the rank information is equal to or higher than a predetermined value.

Subsequently, the feature value selection unit 107 outputs the selected brightness feature value to the target brightness decision unit 108.

Note that, when an input image (image on which a graphic image is not superimposed) is displayed, the feature value selection unit 107 selects and outputs the first feature value.

The target brightness decision unit 108 decides the target brightness according to the brightness feature value output from the feature value selection unit 107. Subsequently, the target brightness decision unit 108 controls the emission brightness of each light source to be the target brightness. Moreover, the target brightness decision unit 108 outputs, to the extension rate decision unit 110, information representing the target brightness of each light source.

(Processing Flow)

The flow of processing in the display apparatus according to this embodiment is now explained in detail. In the ensuing explanation, explained are a case of superimposing a first type graphic image on an original image and displaying the same, and a case of superimposing a second type graphic image on an original image and displaying the same. Here, let it be assumed that the original image is the image shown in FIG. 2A, the first type graphic image is the image shown in FIG. 2B, and the second type graphic image is the image shown in FIG. 2C. The graphic image shown in FIG. 2B is a safety area marker. The graphic image shown in FIG. 2C is a graphic image (GUI image) that forms a user interface (GUI) to be operated by the user viewing the displayed image.

The necessity of attracting attention of the user viewing the displayed image of the safety area marker is lower than that of the GUI image. In addition, when a composite image to which the safety area marker has been composited is displayed, it is likely that the user will focus attention on the region of the original image in comparison to the region of the safety area marker. Moreover, when a composite image to which the GUI image has been composited is displayed, it is likely that the user will focus attention on the region of the GUI image in comparison to the region of the original image. Thus, in this embodiment, when a composite image to which the safety area marker has been composited is displayed, the emission brightness is controlled so that the picture quality of the original image does not deteriorate. Moreover, when a composite image to which the GUI image has been composited is displayed, the emission brightness is controlled so that the picture quality of the graphic image does not deteriorate.

(Process 1)

Foremost, the graphic image generation unit 101 generates graphic image data according to the user operation, and outputs the generated graphic image data to the composite processing unit 102. Moreover, the graphic image generation unit 101 outputs type information to the rank information acquisition unit 105.

When the user operation for displaying a safety area marker is performed, the graphic image data represented with the safety area marker shown in FIG. 2B is generated, and output to the composite processing unit 102. Moreover, the type information "safety area marker" is output to the rank information acquisition unit 105.

Meanwhile, when the user operation for displaying a GUI image is performed, the graphic image data represented with the GUI image shown in FIG. 2C is generated, and output to the composite processing unit 102. Moreover, the type information "GUI image" is output to the rank information acquisition unit 105.

(Process 2)

Subsequently, the composite processing unit 102 generates composite image data by compositing the original image data and the graphic image data.

Figure 2A:
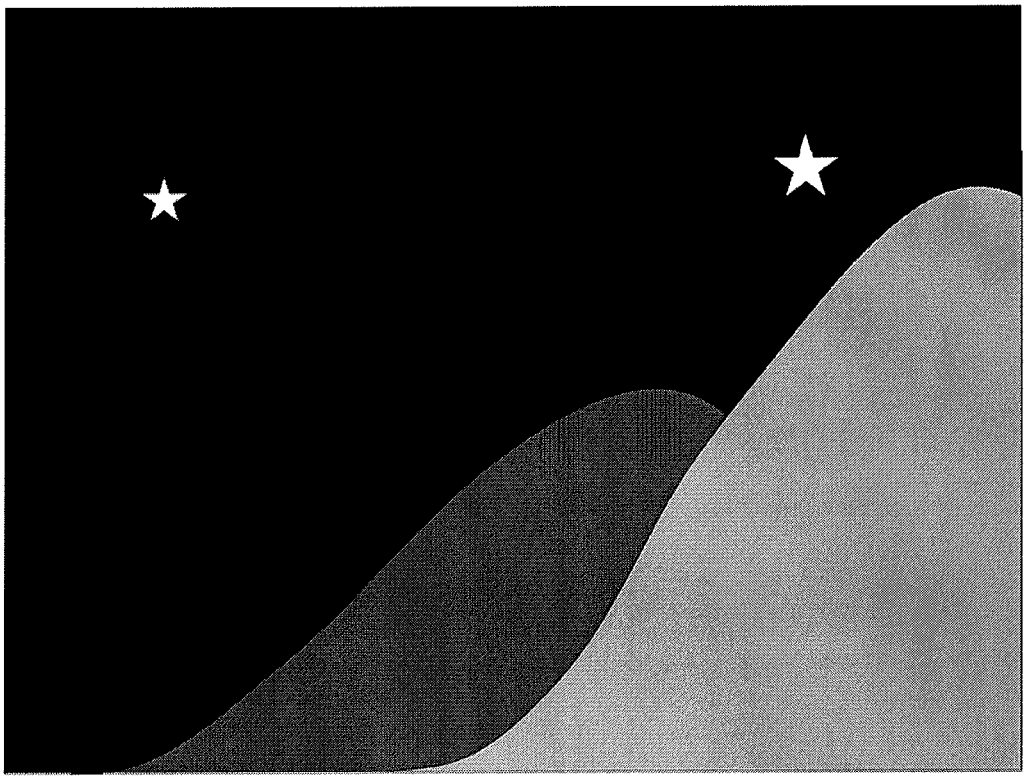
FIGS. 2A to 2E are diagrams showing an example of the various images according to embodiment 1.
Figure 2B:
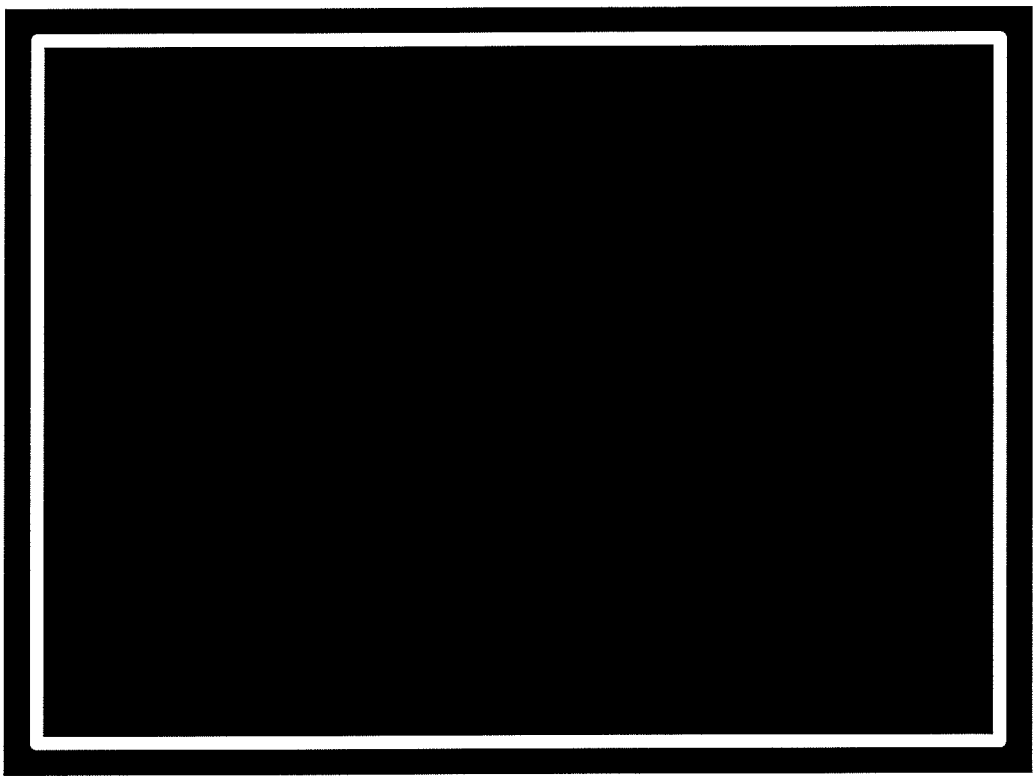
Figure 2C:
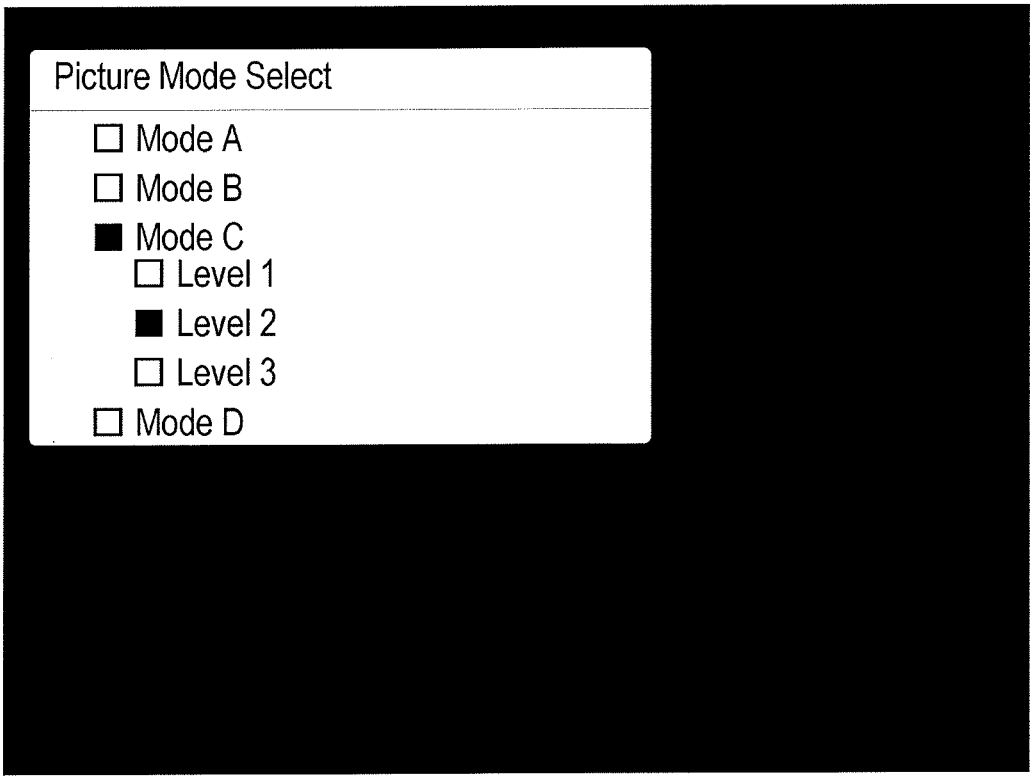
Figure 2D:
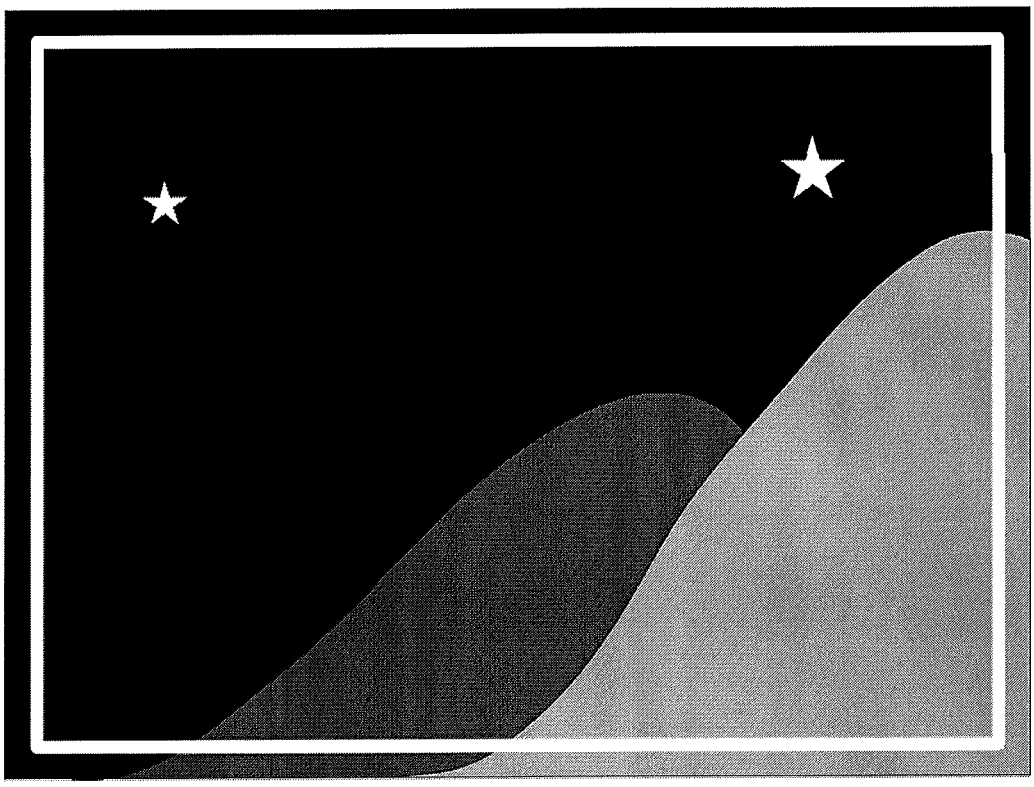

When a composite image to which a safety area marker has been composited is displayed, the composite image data represented with the composite image shown in FIG. 2D (composite image obtained by superimposing the safety area marker shown in FIG. 2B on the original image shown in FIG. 2A) is generated.

Figure 2E:
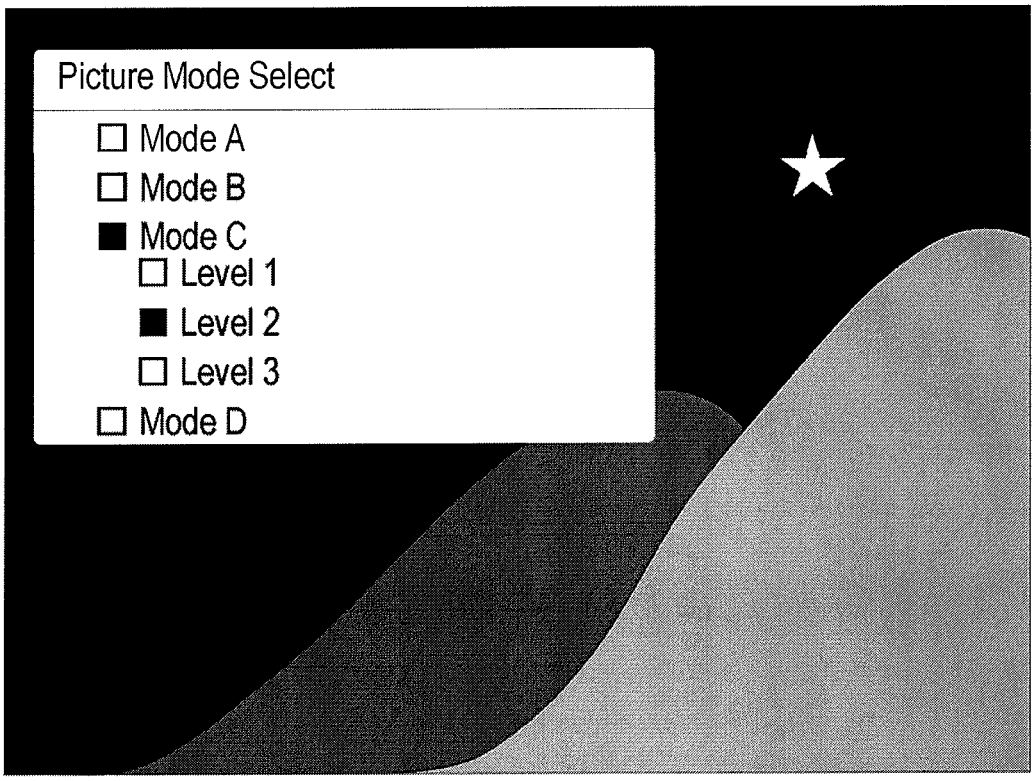

Meanwhile, a composite image to which a GUI image has been composited is displayed, the composite image data represented with the composite image shown in FIG. 2E (composite image obtained by superimposing the GUI image shown in FIG. 2C on the original image shown in FIG. 2A) is generated.

(Process 3)

Subsequently, the first feature value acquisition unit 103 acquires a brightness feature value (first feature value) of each divided region from the original image data. An example of the brightness feature value of each divided region acquired in this process is shown in FIG. 3A. FIG. 3A shows an example where the pixel value is an 8-bit (0 to 255) value, and the brightness feature value is the maximum pixel value. Moreover, FIG. 3A shows an example where the original image data is the original image data representing the original image shown in FIG. 2A, and shows a case where the pixel value of the white regions shown in FIG. 2A is 255.

(Process 4)

Subsequently, the second feature value acquisition unit 104 acquires a brightness feature value (second feature value) from the composite image data output from the composite processing unit 102.

When a composite image to which a safety area marker has been composited is displayed, the brightness feature value is acquired from the composite image data represented with the composite image shown in FIG. 2D. An example of the acquired brightness feature value is shown in FIG. 3B.

Meanwhile, when a composite image to which a GUI image has been composited is displayed, the brightness feature value is acquired from the composite image data represented with the composite image shown in FIG. 2E. An example of the acquired brightness feature value is shown in FIG. 3C.

Note that FIGS. 3B, 3C show an example where the pixel value is an 8-bit (0 to 255) value, the brightness feature value is the maximum pixel value, and the pixel value of the white regions shown in FIGS. 2D, 2E is 255.

Moreover, in FIGS. 3B, 3C, the shaded portions show the divided regions where the brightness feature value has changed due to the composition of the graphic image.

(Process 5)

Subsequently, the rank information acquisition unit 105 outputs, to the rank information storage unit 106, the type information output from the graphic image generation unit 101, and acquires the rank information from the rank information storage unit 106. Subsequently, the rank information acquisition unit 105 outputs the acquired rank information to the feature value selection unit 107.

In this embodiment, rank information storage table as shown in FIG. 4 is stored in the rank information storage unit 106 in advance. In the example of FIG. 4, "1" is set as the rank information of the type information "GUI image", and "0" is set as the rank information of the type information "safety area marker".

Thus, when a composite image to which a safety area marker has been composited is displayed, the rank information acquisition unit 105 outputs the type information "safety area marker" to the rank information storage unit 106. Subsequently, the rank information acquisition unit 105 acquires the rank information "0" from the rank information storage unit 106, and outputs the acquired rank information "0" to the feature value selection unit 107.

Meanwhile, when a composite image to which a GUI image has been composited is displayed, the rank information acquisition unit 105 outputs the type information "GUI image" to the rank information storage unit 106. Subsequently, the rank information acquisition unit 105 acquires the rank information "1" from the rank information storage unit 106, and outputs the acquired rank information "1" to the feature value selection unit 107.

(Process 6)

Subsequently, the feature value selection unit 107 selects either the first feature value or the second feature value according to the rank information output from the rank information acquisition unit 105, and outputs the selected feature value to the target brightness decision unit 108. The selected feature value is acquired. In this embodiment, the feature value selection unit 107 selects the first feature value when the rank information "0" is output from the rank information acquisition unit 105, and selects the second feature value when the rank information "1" is output from the rank information acquisition unit 105.

When a composite image to which a safety area marker has been composited is displayed, the first feature value is selected since the rank information "0" is output from the rank information acquisition unit 105.

Meanwhile, when a composite image to which a GUI image has been composited is displayed, the second feature value is selected since the rank information "1" is output from the rank information acquisition unit 105.

(Process 7)

Subsequently, the target brightness decision unit 108 decides the target brightness according to the brightness feature value output from the feature value selection unit 107. Subsequently, the target brightness decision unit 108 controls the emission brightness of each light source to be the target brightness. Moreover, the target brightness decision unit 108 outputs, to the extension rate decision unit 110, information representing the target brightness of each light source. In this embodiment, let it be assumed that the emission brightness is controlled to be 100% (maximum value that is allowable for the emission brightness) when the brightness feature value is 255, and let it be assumed that the emission brightness is controlled to be 0% (minimum value that is allowable for the emission brightness) when the brightness feature value is 0.

As described above, when a composite image to which a safety area marker is composited is displayed, the first feature value is output from the feature value selection unit 107. Thus, the target brightness decision unit 108 decides the target brightness according to the first feature value, and thereby controls the emission brightness.

Figure 6A:
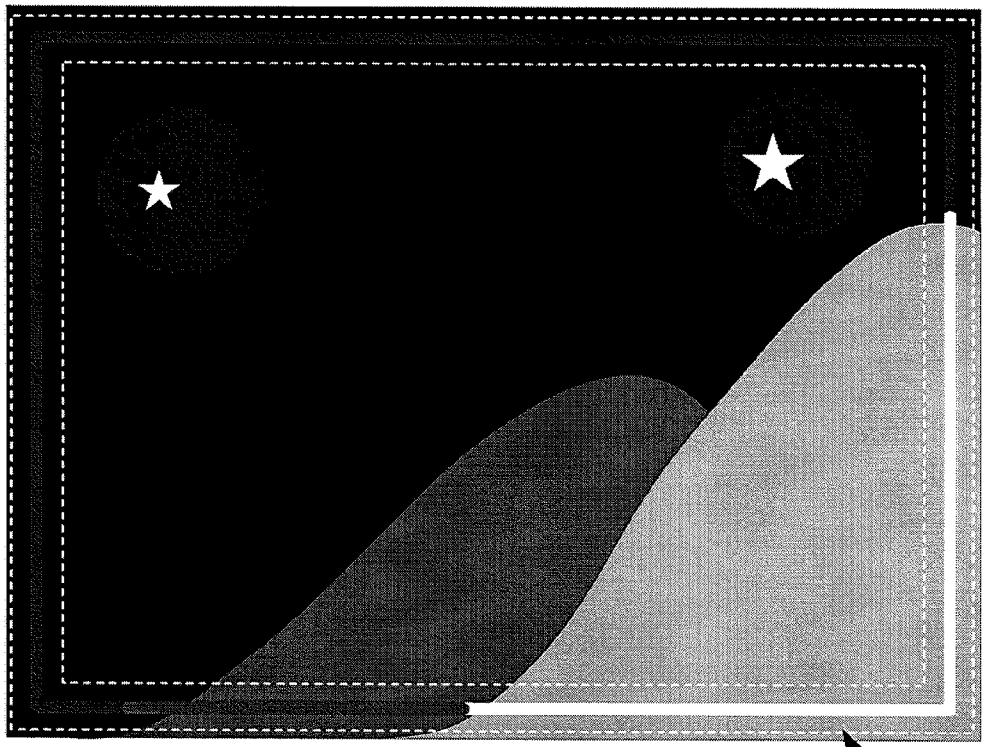
FIGS. 6A, 6B are diagrams showing an example of the displayed image according to embodiment 1.

Specifically, when a composite image to which a safety area marker is composited is displayed, the emission brightness is controlled to be the target brightness shown in FIG. 5A. Consequently, the displayed image shown in FIG. 6A is displayed. In FIG. 5A, the numerical value indicated in the divided region shows the target brightness of the light source corresponding to that divided region. From FIG. 5A, it can be understood that the target brightness is decided according to the brightness of the original image. In addition, from FIG. 6A, it can be understood that the picture quality of the region of the original image in the displayed image is not affected by the superimposed display of the graphic image. In other words, when a composite image to which a safety area marker has been composited is displayed, it can be understood that the emission brightness is controlled so that the picture quality of the original image does not deteriorate.

Meanwhile, when a composite image to which a GUI image has been composited is displayed, the second feature value is output from the feature value selection unit 107. Thus, the target brightness decision unit 108 decides the target brightness according to the second feature value, and thereby controls the emission brightness.

Figure 6B:
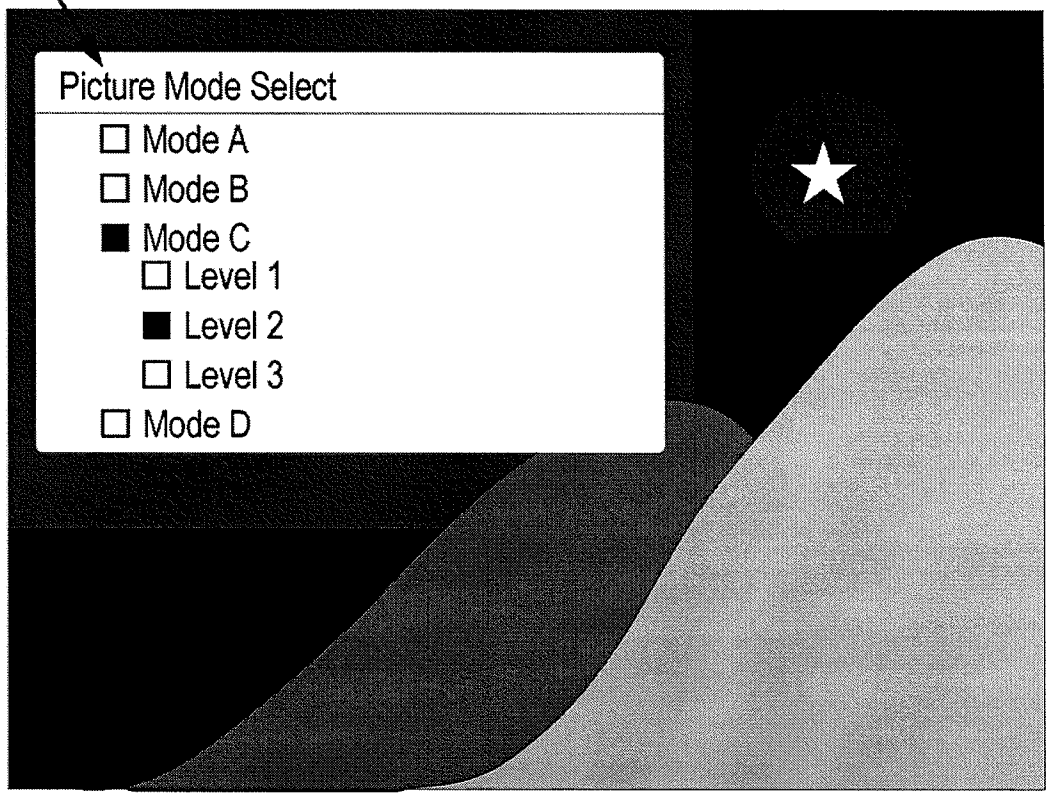

Specifically, when a composite image to which a GUI image is composited is displayed, the emission brightness is controlled to be the target brightness shown in FIG. 5B. Consequently, the displayed image shown in FIG. 6B is displayed. Based on FIG. 5B, it can be understood that the target brightness is decided according to the brightness of the composite image. In addition, from FIG. 6B, it can be understood that the emission brightness is controlled so that the picture quality of the graphic image does not deteriorate.

(Process 8)

Subsequently, the extension rate decision unit 110 decides the extension rate of the pixel value of the image data on the basis of the target brightness decided by the emission brightness control unit 113 for each divided region. In this embodiment, the maximum value that is allowable for the target brightness (emission brightness) is used as the reference brightness, and a larger value is decided as the extension rate as the target brightness is lower. Specifically, the reciprocal number of the target brightness is decided as the extension rate.

Note that the reference brightness may also be smaller than the maximum value that is allowable for the target brightness (emission brightness). Moreover, the reference brightness may or may not be a fixed value that is predetermined by a manufacturer or the like. For example, the reference brightness may also be a value that can be set and changed by the user.

Note that, in cases where the target brightness may be higher or lower than the reference brightness, for example, "1" may be decided as the extension rate when the target brightness is the reference brightness. When the target brightness is higher than the reference brightness, a smaller value may be decided as the extension rate as the target brightness is higher, and when the target brightness is lower than the reference brightness, a larger value may be decided as the extension rate as the target brightness is lower.

Note that the extension rate may also be decided so that the change in brightness on the screen caused by the change in the emission brightness of the light source can be more favorably compensated in consideration of the leaked light from the light source to other divided regions.

(Process 9)

Subsequently, the image processing unit 111 corrects the pixel value of the composite image data on the basis of the extension rate decided by the extension rate decision unit 110. Subsequently, the image processing unit 111 outputs, to the liquid crystal panel 112, the image data that was subject to image processing. A composite image is thereby displayed on the screen.

As described above, according to this embodiment, when a graphic image is superimposed on an original image and is displayed, the emission brightness of each light source can be changed according to the type of graphic image to be superimposed. In addition, when the type of graphic image to be superimposed is a first type, the emission brightness is controlled to be a value according to the brightness of the original image, and, when the type of graphic image to be superimposed is a second type, the emission brightness is controlled to be a value according to the brightness of the composite image. It is thereby possible to control the emission brightness of each light source to be an appropriate value when a graphic image is superimposed on an original image and is displayed.

Note that the order of processes 1 to 9 is not limited to the foregoing order. For example, so as long as process 3 is performed before process 6, process 3 may be performed at any timing. So as long as process 5 is performed between process 1 and process 6, process 5 may be performed at any timing. Moreover, a plurality of processes may be performed in parallel. For example, process 3 and process 4 may be performed in parallel. Process 7 and processes 8 and 9 may be performed in parallel.

Note that, while this embodiment a case where the first type graphic image is a safety area marker and the second type graphic image is a GUI image, the first type graphic image and the second type graphic image are not limited thereto. So as long as the emission brightness of each light source can be changed according to the type of graphic image, the first type and the second type may be any type. However, when a graphic image in which the necessity of attracting attention of the user viewing the displayed image is high is superimposed and is displayed, it is likely that the display of a composite image with a highly visible graphic image will be desired. Moreover, when a graphic image in which the necessity of attracting attention of the user viewing the displayed image is low is superimposed and displayed, it is likely that the display of a composite image with no deterioration in the picture quality in the regions of the original image will be desired. Thus, the second type graphic image is preferably a graphic image in which the necessity of attracting attention of the user viewing the displayed image is higher than that of the first type graphic image.

Note that, while this embodiment explained a case of changing the emission brightness of each light source on the basis of the rank information corresponding to the type of graphic image to be superimposed, the configuration is not limited thereto. For example, the emission brightness of each light source may be changed on the basis of the type information without using the rank information. Specifically, the correspondence relation of the type information and the selected brightness feature value (first feature value or second feature value) may be set in advance. In addition, the brightness feature value corresponding to the type information may be selected, and the emission brightness may be controlled according to the selected brightness feature value.

Note that, while this embodiment explained a case where there are two types of rank information; namely, "0" and "1", the rank information may also be three types or more. For example, the rank information may be the five types of "0", "1", "2", "3", and "4". In the foregoing case, for example, the first feature value may be selected when the value of the rank information is lower than a predetermined value (for instance, 3), and the second feature value may be selected when the value of the rank information is equal to or higher than a predetermined value.

Note that, while this embodiment explained a case of selecting either the first feature value or the second feature value, and controlling the emission brightness to be a value according to the brightness of the original image or a value according to the brightness of the composite image, the configuration is not limited thereto. For example, when the type of graphic image to be superimposed is a third type, the emission brightness of each light source may be controlled to be a value that is between the emission brightness according to the brightness of the original image and the emission brightness according to the brightness of the composite image. According to this kind of configuration, for example, when the type of graphic image to be superimposed is a third type, it is possible to select both the first feature value and the second feature value, and control the emission brightness to be a value according to the average value thereof. According to this kind of configuration, the emission brightness of each light source can be controlled to be an appropriate value even in cases of superimposing a third type graphic image on an original image and displaying the same.

The third type graphic image is, for example, an audio level meter.

Moreover, the emission brightness of each light source may also be controlled to be a value that is obtained by combining the emission brightness according to the brightness of the original image and the emission brightness according to the brightness of the composite image on the basis of a weight according to the type of graphic image to be superimposed. For example, weight information (0 to 1) representing the weight of the first feature value may be set in advance for each type of graphic image. In addition, the brightness feature value Ca may be calculated using Formula 1 below, and the emission brightness may be controlled according to the calculated brightness feature value C. In Formula 1, W is the weight that is represented with the weight information corresponding to the type of graphic image to be superimposed. C1 is the first feature value, and C2 is the second feature value. According to this kind of configuration, the emission brightness of each light source can be controlled to be an appropriate value regardless of the type of graphic image that is superimposed and displayed on the original image.

$$Ca = C1 \times W + C2 \times (1 - W) \quad \text{(Formula 1)}$$

<Embodiment 2>

The display apparatus and its control method according to embodiment 2 of the present invention are now explained.

In embodiment 1, when a first type graphic image (safety area marker) is superimposed on an original image and is displayed, the emission brightness is controlled according to the brightness of the original image. Thus, when the original image is a dark image (low brightness image; image which is dark as a whole), the visibility of the safety area marker will deteriorate considerably in the displayed image.

Thus, in this embodiment, when a first type graphic image (safety area marker) is superimposed on an original image and is displayed and when the original image is a low brightness image, processing that differs from embodiment 1 is performed. Specifically, the emission brightness of light sources, among a plurality of light sources, corresponding to the regions where the graphic image is displayed is controlled to be a value that is higher than that of the emission brightness according to the brightness of the original image. Moreover, with regard to the other light sources, the emission brightness is control led according to the brightness of the original image as with embodiment 1. It is thereby possible to suppress the deterioration in the picture quality of the original image, and display a displayed image in which the deterioration in the visibility of the safety area marker has been suppressed.

(Overall Configuration)

Figure 7:
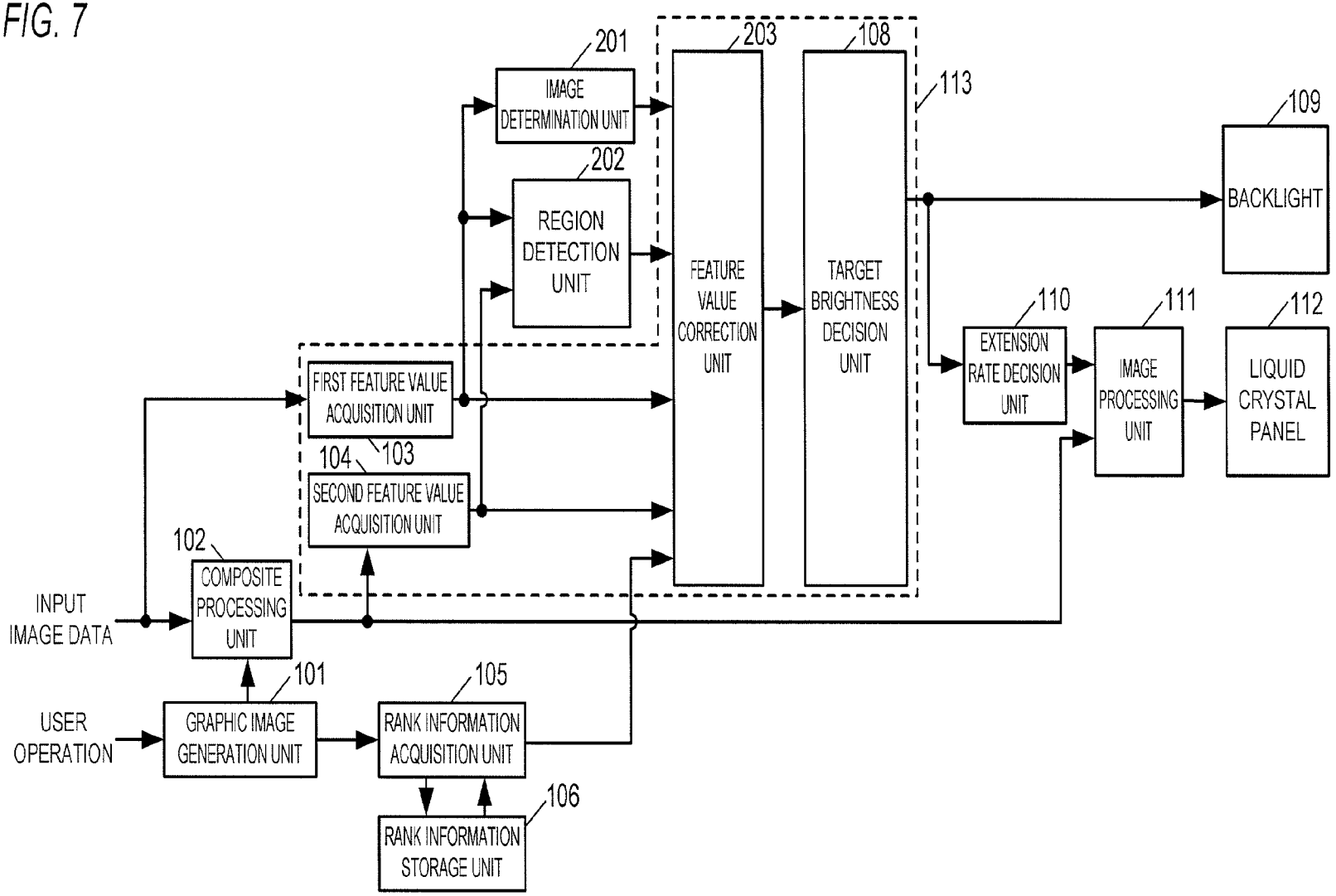
FIG. 7 is a block diagram showing an example of the functional configuration of the display apparatus according to embodiment 2.

FIG. 7 is a block diagram showing an example of the functional configuration of the display apparatus according to this embodiment. As shown in FIG. 7, the display apparatus according to this embodiment includes an image determination unit 201 and a region detection unit 202 in addition to the functional units of the display apparatus of embodiment 1. Moreover, the display apparatus according to this embodiment includes a feature value correction unit 203 in substitute for the feature value selection unit 107 of embodiment 1.

The respective functional units of the display apparatus according to this embodiment are now explained.

Note that the same reference numeral is given to the same functional unit as embodiment 1, and the explanation thereof is omitted.

The image determination unit 201 determines whether the original image is a low brightness image. In this embodiment, the image determination unit 201 determines that the original image is a low brightness image when the brightness of the original image is less than a threshold in all of the respective regions (divided regions) each corresponding to the plurality of light sources, and determines that the original image is not a low brightness image in all other cases. Specifically, the image determination unit 201 acquires a first feature value from the first feature value acquisition unit 103. Subsequently, the image determination unit 201 determines that the original image is a low brightness image when the first feature value of all divided regions is less than a threshold, and determines that the original image is not a low brightness image when the first feature value of any divided region is not less than a threshold.

Note that, in this embodiment, while the threshold of the first feature value is 16, the threshold may be greater than or less than 16.

Moreover, the threshold of the brightness and the first feature value may or may not be a fixed value that is predetermined by a manufacturer or the like. For example, the threshold of the brightness and the first feature value may also be a value that can be set and changed by the user.

The region detection unit 202 detects the regions where the graphic image is displayed among the plurality of regions (divided regions) corresponding to the plurality of light sources. In this embodiment, foremost, the region detection unit 202 acquires a first feature value from the first feature value acquisition unit 103, and acquires a second feature value from the second feature value acquisition unit 104. Subsequently, the region detection unit 202 calculates the difference between the first feature value and the second feature value for each divided region. Subsequently, the region detection unit 202 detects a division region in which the difference is not 0 as a region where the graphic image is displayed.

The feature value correction unit 203 calculates a composite feature value by compositing the first feature value and the second feature value on the basis of a weight according to the rank information output from the rank information acquisition unit 105, and outputs the calculated composite feature value to the target brightness decision unit 108. Specifically, the composite feature value Cb is calculated using Formula 2 below. In Formula 2, W is the weight (weight of second feature value) according to the rank information. C1 is the first feature value, and C2 is the second feature value. When the rank information is "0", then W=0 (0%), and when the rank information is "1", then W=1 (100%).

$$Cb=C1\times(1-W)+C2\times W \quad \text{(Formula 2)}$$

When the rank information is "0", then W=0 (0%), and when the rank information is "1", then W=1 (100%). Thus, when a composite image to which a safety area marker has been composited is displayed, the first feature value is output as the composite feature value, and when a composite image to which a GUI image has been composited is displayed, the second feature value is output as the composite feature value.

Note that the target brightness decision unit 108 controls the emission brightness according to the composite feature value.

Moreover, the feature value correction unit 203 acquires a determination result from the image determination unit 201, and acquires a detection result from the region detection unit 202. In addition, when the rank information is "0" and the original image is a low brightness image, the feature value correction unit 203 corrects the weight W regarding the divided regions where the graphic image is displayed to be a value that is higher than 0. In this embodiment, when the rank information is "0" and the original image is a low brightness image, the feature value correction unit 203 corrects the weight W regarding the divided regions where the graphic image is displayed to be a predetermined value. Consequently, the emission brightness of the light sources, among the plurality of light sources, corresponding to the regions where the graphic image is displayed is controlled to be a value that is higher by a predetermined value than the emission brightness according to the brightness of the original image. It is thereby possible to suppress the deterioration in the visibility of the safety area marker.

Note that 0 is used as the weight W regarding the divided regions other than the divided regions where the graphic image is displayed. It is thereby possible to suppress the deterioration in the picture quality of the original image.

Note that, in this embodiment, while the foregoing predetermined value set as the weight W is 0.05 (5%), the predetermined value may be greater than or less than 0.05.

Moreover, the method of correcting the weight W is not limited to the foregoing method. For example, the weight W may be corrected to be greater as the overall brightness of the original image is lower.

(Processing Flow)

The flow of processing in the display apparatus according to this embodiment is now explained in detail. In the ensuing explanation, as shown in FIG. 8, explained is a case of displaying a composite image obtained by compositing a white safety area marker with an original image that is entirely black.

(Processes 1 to 5)

Processes 1 to 5 are the same as processes 1 to 5 of embodiment 1.

Figure 8:
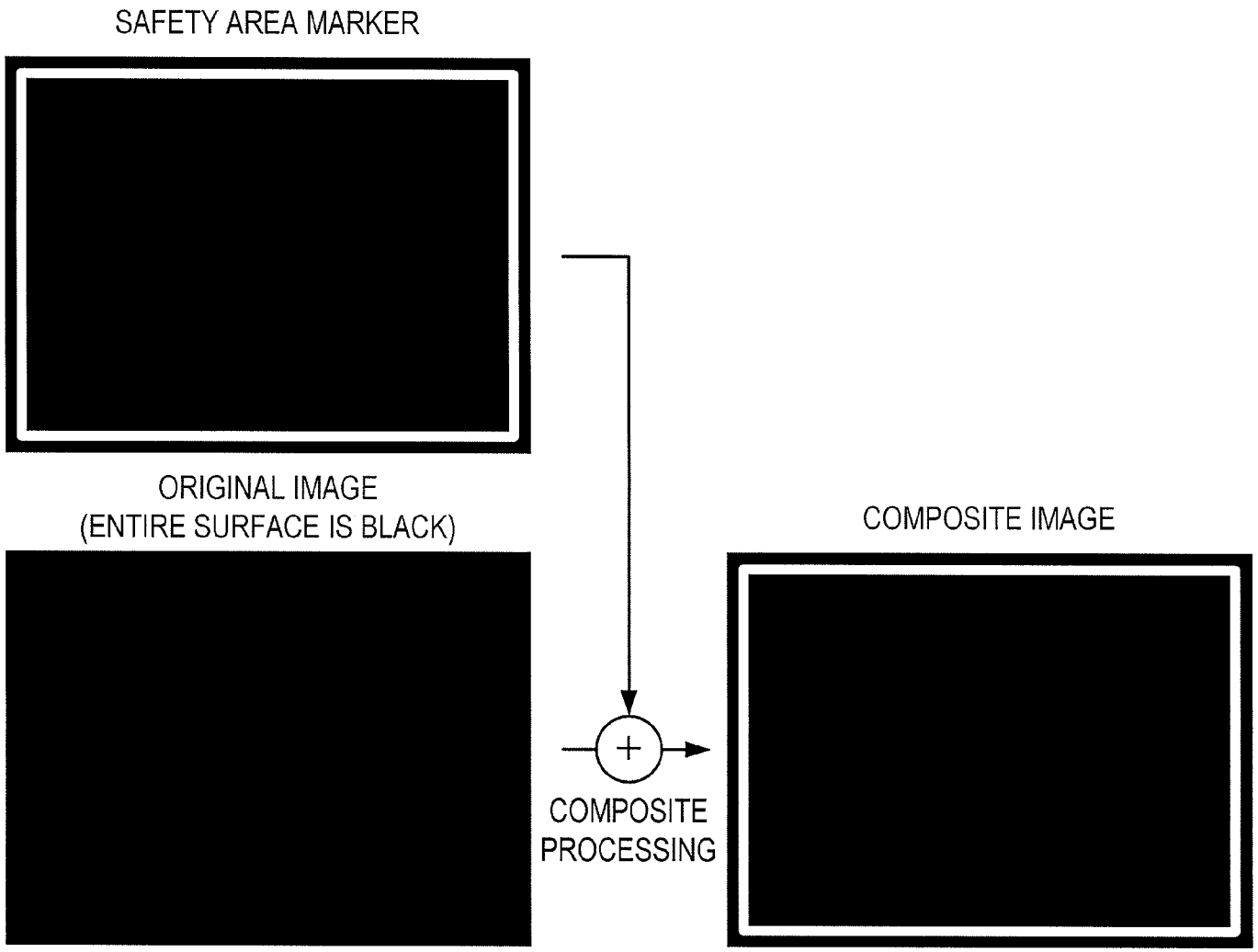
FIG. 8 is a diagram showing an example of the various images according to embodiment 2.

In process 2, the composite image data representing the composite image shown in FIG. 8 is generated.

In process 3, the brightness feature value (first feature value) shown in FIG. 9A is acquired.

In process 4, the brightness feature value (second feature value) shown in FIG. 9B is acquired.

(Process 6)

Subsequently, the image determination unit 201 determines whether the original image is a low brightness image. Here, as shown in FIG. 9A, since all first feature values are a value (0) that is smaller than the threshold (16), it is determined that the original image is a low brightness image. Subsequently, the image determination unit 201 outputs the determination result to the feature value correction unit 203. For example, when it is determined that the original image is a low brightness image, "1" is output as the determination result, and when it is determined that the original image is not a low brightness image, "0" is output as the determination result.

Note that process 6 may be performed at any timing so as long as it is after process 3 and before process 8 described later.

(Process 7)

Subsequently, the region detection unit 202 detects the divided regions where the graphic image is displayed. Here, the difference between the first feature value shown in FIG. 9A and the second feature value shown in FIG. 9B is calculated for each divided region. FIG. 10A shows the difference of each divided region. In addition, since the difference between the first feature value and the second feature value is not "0" in the shaded portions of FIG. 10A, the divided regions of the shaded portions of FIG. 10A are detected as the divided regions where the graphic image is displayed.

Subsequently, the region detection unit 202 outputs the detection result to the feature value correction unit 203. For example, region information in which "1" is assigned to the divided regions where the graphic image is displayed and "0" is assigned to the other divided regions is output as the detection result. The region information obtained from the difference of FIG. 10A is shown in FIG. 10B.

Note that process 7 may be performed at any timing so as long as it is after process 5 and before process 8 described later. For example, process 7 may be performed before process 6, or in parallel with process 6.

(Process 8)

Subsequently, the feature value correction unit 203 calculates a composite feature value of each divided region. Here, the rank information is "0", and the original image is a low brightness image. Thus, the composite feature value is calculated using weight W=0.05 regarding the divided regions where the graphic image is displayed, and the composite feature value is calculated using weight W=0 regarding the other divided regions (first feature value is calculated as composite feature value). The composite feature value of each divided region is shown in FIG. 11A.

(Process 9 to 11)

Processes 9 to 11 are the same as processes 7 to 9 of embodiment 1.

Figure 11A:
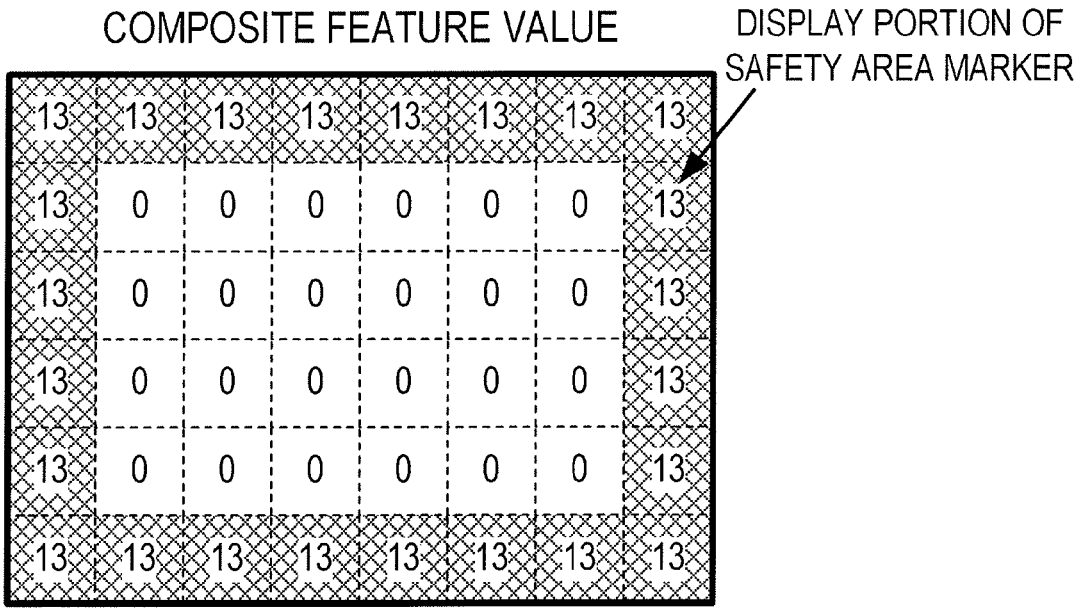
FIGS. 11A to 11C are diagrams showing an example of the target brightness and effect according to embodiment 2.
Figure 11B:
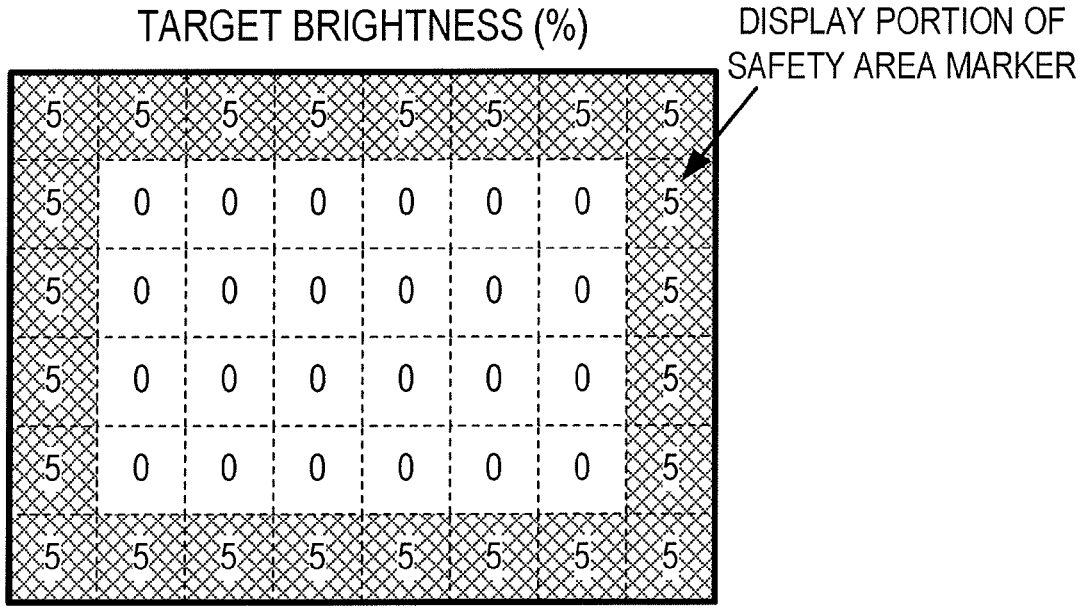

In process 9, the target brightness shown in FIG. 11B is decided from the composite feature value shown in FIG. 11A.

Figure 11C:
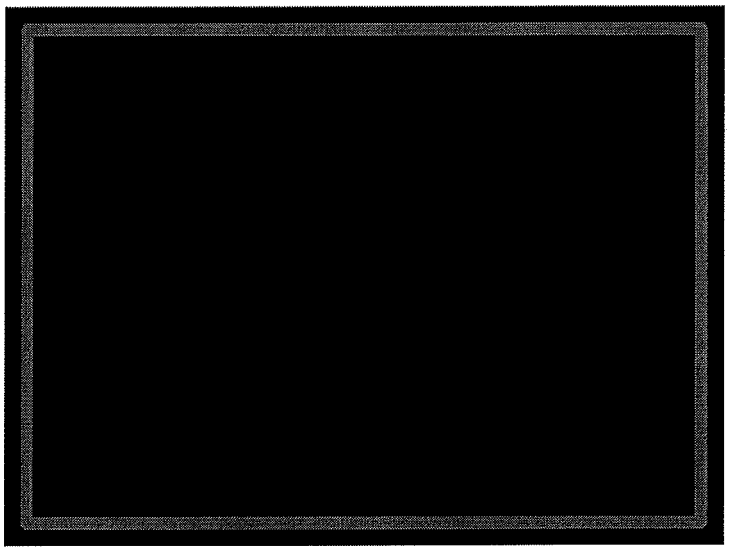

Then, after foregoing processes 1 to 11 are performed, the safety area marker can be displayed as a visible displayed image as shown in FIG. 11C.

As described above, according to this embodiment, when a first type graphic image is superimposed on an original image and is displayed and the original image is a dark image, processing that differs from embodiment 1 is performed. Specifically, in the foregoing case, the emission brightness of the light sources corresponding to the regions where the graphic image is displayed is controlled to be a value that is higher than that of the emission brightness according to the brightness of the original image. Consequently, when a first type graphic image is superimposed on an original image and is displayed and when the original image is a dark image, the emission brightness of each light source can be controlled to be an appropriate value. Specifically, in the foregoing case, the emission brightness can be controlled so as to suppress the deterioration in the picture quality of the original image, and display a displayed image in which the deterioration in the visibility of the safety area marker has been suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s).

This application claims the benefit of Japanese Patent Application No. 2013-162572, filed on Aug. 5, 2013, which is hereby incorporated by reference herein in its entirety.

What is claimed is:

1. A display apparatus, comprising:

a light-emitting unit having a plurality of light sources, the emission brightness of which can be individually changed;

a display unit configured to display an image on a screen by modulating light from the light-emitting unit; and a control unit configured to control the emission brightness of each of the light sources according to a brightness of an image to be displayed in a region on the screen corresponding to each of the plurality of light sources, wherein when a graphic image is superimposed on an original image and is displayed, the control unit changes the emission brightness of each of the light sources according to a type of the graphic image so that the emission brightness becomes equal to an emission brightness according to a brightness of the original image when the type of the graphic image is a first type, and so that the emission brightness becomes equal to an emission brightness according to a brightness of a composite image obtained by compositing the graphic image on the original image when the type of the graphic image is a second type.

2. The display apparatus according to claim 1, wherein the second type graphic image is a graphic image in which a necessity of attracting attention of a user viewing a displayed image is higher than that of the first type graphic image.

3. The display apparatus according to claim 1, wherein the second type graphic image is a graphic image that forms a user interface to be operated by a user viewing a displayed image.

4. The display apparatus according to claim 1, wherein the first type graphic image is a safety area marker.

5. The display apparatus according to claim 1, wherein when the graphic image is superimposed on the original image and is displayed and when the type of the graphic image is a third type, the control unit controls the emission brightness of each of the light sources to a value that is between the emission brightness according to the brightness of the original image and the emission brightness according to the brightness of the composite image.

6. The display apparatus according to claim 5, wherein the third type graphic image is an audio level meter.

7. The display apparatus according to claim 1, wherein when the graphic image is superimposed on the original image and is displayed, the control unit controls the emission brightness of each of the light sources to a value obtained by combining the emission brightness according to the brightness of the original image and the emission brightness according to the brightness of the composite image on the basis of a weight according to the type of the graphic image.

8. The display apparatus according to claim 1, wherein rank information representing the level of necessity of attracting attention of a user viewing a displayed image is set in advance for each type of graphic image, and wherein when the graphic image is superimposed on the original image and is displayed, the control unit changes the emission brightness of each of the light sources on the basis of the rank information corresponding to the type of the graphic image to be superimposed.

9. The display apparatus according to claim 1, wherein when the first type graphic image is superimposed on the original image and is displayed and when the original image is a dark image, the control unit controls the emission brightness of a light source, among the plurality of light sources, corresponding to a region displaying the graphic image to a higher value than the emission brightness according to the brightness of the original image.

10. The display apparatus according to claim 9, further comprising:

a determination unit configured to determine that the original image is a dark image when the brightness of the original image is less than a threshold in all of the respective regions each corresponding to the plurality of light sources, and determine that the original image is not a dark image in all other cases.

11. The display apparatus according to claim 1, wherein when the first type graphic image is superimposed on the original image and is displayed and when the original image is a dark image, the control unit controls the emission brightness of a light source, among the plurality of light sources, corresponding to a region displaying the graphic image to a value that is higher, by a predetermined value, than the emission brightness according to the brightness of the original image.

12. A control method for a display apparatus including a light-emitting unit having a plurality of light sources, the emission brightness of which can be individually changed, and a display unit that displays an image on a screen by modulating light from the light-emitting unit, the control method comprising the following steps executed by a processor:

an input step of inputting the image data into the display unit; and a control step of controlling the emission brightness of each of the light sources according to a brightness of an image to be displayed in a region on the screen corresponding to each of the plurality of light sources, wherein when a graphic image is superimposed on an original image and is displayed, in the control step, the emission brightness of each of the light sources is changed according to a type of the graphic image so that the emission brightness becomes equal to an emission brightness according to a brightness of the original image when the type of the graphic image is a first type, and so that the emission brightness becomes equal to an emission brightness according to a brightness of a composite image obtained by compositing the graphic image on the original image when the type of the graphic image is a second type.

13. The control method according to claim 12, wherein the second type graphic image is a graphic image in which a necessity of attracting attention of a user viewing a displayed image is higher than that of the first type graphic image.

14. The control method according to claim 12, wherein the second type graphic image is a graphic image that forms a user interface to be operated by a user viewing a displayed image.

15. The control method according to claim 12, wherein the first type graphic image is a safety area marker.

16. The control method according to claim 12, wherein when the graphic image is superimposed on the original image and is displayed and when the type of the graphic image is a third type, in the control step, the emission brightness of each of the light sources is controlled to a value that is between the emission brightness according to the brightness of the original image and the emission brightness according to the brightness of the composite image.

17. The control method according to claim 12, wherein when the graphic image is superimposed on the original image and is displayed, in the control step, the emission brightness of each of the light sources is controlled to a value obtained by combining the emission brightness according to the brightness of the original image and the emission brightness according to the brightness of the composite image on the basis of a weight according to the type of the graphic image.

18. The control method according to claim 12, wherein rank information representing the level of necessity of attracting attention of a user viewing a displayed image is set in advance for each type of graphic image, and wherein when the graphic image is superimposed on the original image and is displayed, in the control step, the emission brightness of each of the light sources is changed on the basis of the rank information corresponding to the type of the graphic image to be superimposed.

19. The control method according to claim 12, wherein when the first type graphic image is superimposed on the original image and is displayed and when the original image is a dark image, in the control step, the emission brightness of a light source, among the plurality of light sources, corresponding to a region displaying the graphic image is controlled to a higher value than the emission brightness according to the brightness of the original image.

20. The control method according to claim 12, wherein when the first type graphic image is superimposed on the original image and is displayed and when the original image is a dark image, in the control step, the emission brightness of a light source, among the plurality of light sources, corresponding to a region displaying the graphic image is controlled to a value that is higher, by a predetermined value, than the emission brightness according to the brightness of the original image.

* * * * *